US008561585B2

(12) United States Patent
Miyoshi et al.

(10) Patent No.: US 8,561,585 B2
(45) Date of Patent: Oct. 22, 2013

(54) ROCKER ARM UNIT

(75) Inventors: Tomoki Miyoshi, Nishio (JP); Masahide Sakurai, Nishio (JP); Naoki Hiramatsu, Nishio (JP); Toshimasa Sasaki, Kariya (JP)

(73) Assignee: OTICS Corporation, Aichi (JP)

( * ) Notice: Subject to any disclaimer, the term of this patent is extended or adjusted under 35 U.S.C. 154(b) by 559 days.

(21) Appl. No.: 12/850,994

(22) Filed: Aug. 5, 2010

(65) Prior Publication Data

US 2011/0041791 A1 Feb. 24, 2011

(30) Foreign Application Priority Data

Aug. 18, 2009 (JP) ..... 2009-189208

(51) Int. Cl.
*F01L 9/02* (2006.01)

(52) U.S. Cl.
USPC ..... 123/90.39; 123/90.44; 74/559; 74/569

(58) Field of Classification Search
USPC ..... 123/90.39, 90.44, 90.45; 74/559, 567, 74/569
See application file for complete search history.

(56) References Cited

U.S. PATENT DOCUMENTS

| | | | |
|---|---|---|---|
| 3,002,507 | A | 10/1961 | Bensinger et al. |
| 4,494,729 | A | 1/1985 | Krüger |
| 5,325,825 | A | 7/1994 | Schmidt et al. |
| 5,775,280 | A | 7/1998 | Schmidt et al. |
| 6,047,675 | A | 4/2000 | Kunz |
| 6,543,402 | B2 | 4/2003 | Burns |
| 6,941,915 | B1 | 9/2005 | Masello et al. |
| 7,089,900 | B2 | 8/2006 | Masello et al. |
| 7,146,950 | B2 | 12/2006 | Moeck et al. |
| 7,350,490 | B2 | 4/2008 | Mock et al. |
| 2001/0035144 | A1 | 11/2001 | Burns |
| 2006/0225680 | A1 | 10/2006 | Engelhardt et al. |
| 2011/0000451 | A1 | 1/2011 | Kraus |
| 2011/0017160 | A1 | 1/2011 | Kishi et al. |

FOREIGN PATENT DOCUMENTS

| | | |
|---|---|---|
| DE | 2 309 460 | 8/1974 |
| DE | 2309460 A1 | 8/1974 |
| DE | 3118466 | 11/1982 |
| DE | 196 17 523 | 11/1997 |
| DE | 196 17 523 A1 | 11/1997 |

(Continued)

OTHER PUBLICATIONS

European Search Report dated Oct. 10, 2010 for Application No. EP 10 00 8486.

(Continued)

*Primary Examiner* — Ching Chang
(74) *Attorney, Agent, or Firm* — Smith, Gambrell and Russell, LLP.

(57) ABSTRACT

A rocker arm unit constituting a valve gear includes a support member, a rocker arm including a roller and walls opposed to each other with the roller being interposed between them and a wire member bridging the support member side and the rocker arm side with each other. The walls have shaft holes into which both ends of a shaft member rotatably supporting the roller extend respectively. The walls have lengthwise ends connected to each other via a receiving portion supported on a top of the support member so that the rocker arm is swung. The wire member has an extending portion extending from the support member side to the rocker arm side and having a distal end. The rocker arm side includes a part located away from the receiving portion. The distal end of the extending portion serves as an engagement portion engaging the rocker arm side part.

17 Claims, 11 Drawing Sheets

(56) References Cited

FOREIGN PATENT DOCUMENTS

| | | | |
|---|---|---|---|
| DE | 197 14 822 | | 10/1998 |
| DE | 197 14 822 | A1 | 10/1998 |
| GB | 963995 | | 7/1964 |
| JP | S59-168208 | A | 9/1984 |
| JP | 60-32504 | | 3/1985 |
| JP | 60-198313 | | 10/1985 |
| JP | 62-169203 | | 10/1987 |
| JP | S64-25409 | U | 2/1989 |
| JP | 2520603 | | 10/1996 |
| JP | 10-37719 | | 2/1998 |
| JP | 2001-271614 | | 10/2001 |
| JP | 2001-317310 | | 11/2001 |
| JP | 2002-155710 | | 5/2002 |
| JP | 2004-278377 | | 10/2004 |
| JP | 2009-257313 | A | 11/2009 |
| WO | 2004/038186 | | 5/2004 |
| WO | 2009/038935 | | 3/2009 |

OTHER PUBLICATIONS

US Office Action mailed Sep. 2, 2010 for U.S. Appl. No. 12/920,748.

Partial English language translation of an excerpt from the Japanese Office Action mailed Apr. 9, 2013 for Japanese Application No. 2009-189208.

ROCKER ARM UNIT

CROSS-REFERENCE TO RELATED APPLICATIONS

This application is based on and claims the benefit of priority from the prior Japanese Patent Application No. 2009-189208, filed on Aug. 18, 2009, the entire contents of which are incorporated herein by reference.

BACKGROUND ART

1. Technical Field

The present disclosure relates to a rocker arm unit constituting a valve gear for internal combustion engines such as gasoline engines, diesel engines and the like.

2. Related Art

Japanese patent application publication JP-A-2002-155710 discloses a rocker arm unit comprising a rocker arm, a lash adjuster supporting the rocker arm so that the rocker arm is swingable, and a plate-shaped clip bridging the lash adjuster side and the rocker arm side with each other thereby to connect both sides. The rocker arm is swung by rotation of a cam in order to open and close a valve. The lash adjuster automatically adjusts a valve clearance. The clip realizes a combined handling of the lash adjuster and the rocker arm, thereby improving the assembling of the lash adjuster and the rocker arm onto a cylinder head of an internal combustion engine.

The aforementioned clip is made by punching out a metal plate according to shapes of attachment portions of the lash adjuster and the rocker arm and thereafter bending the metal plate. This increases a manufacturing cost of the clip, posing a problem.

SUMMARY

Therefore, an object of the disclosure is to provide a rocker arm unit which can reduce the manufacturing cost thereof.

There is provided a rocker arm unit constituting a valve gear of an internal combustion engine having a cylinder head, the unit comprising a support member assembled into the cylinder head, a rocker arm including a roller configured for rotation by a cam and a pair of walls opposed to each other with the roller being interposed therebetween, the walls having shaft holes into which both ends of a shaft member rotatably supporting the roller extend respectively, the walls having respective lengthwise ends connected via a receiving portion to each other, the receiving portion being supported on a top of the support member so that the rocker arm is swung with the receiving portion serving as an approximate fulcrum, and a wire member bridging the support member side and the rocker arm side with each other thereby to connect the support member and the rocker arm together, the wire member having an extending portion which extends from the support member side to the rocker arm side and has a distal end, the rocker arm side including a part located away from the receiving portion, the distal end of the extending portion serving as an engagement portion which engages said part of the rocker arm side. Also, the engagement portion is inclusive of a pair of engagement portion extensions formed in the wire member with each having a distal end configured for engagement with the rocker arm side as in a projection-recess relationship and with the distal ends extending parallel with the roller's axis of rotation.

In the above-described rocker arm unit, the member connecting the support member and the rocker arm together comprises the wire member. Differing from the conventional clip, the wire member does not necessitate the work of punching a metal plate into a predetermined shape and of shaping the metal plate into a complicated shape.

DETAILED DESCRIPTION

A first embodiment will be described with reference to FIGS. 1 to 4. A rocker arm unit 10 according to the first embodiment constitutes a valve gear of internal combustion engine and includes a rocker arm 20, a lash adjuster 40 as a support member and a wire member 80.

Figure 4:
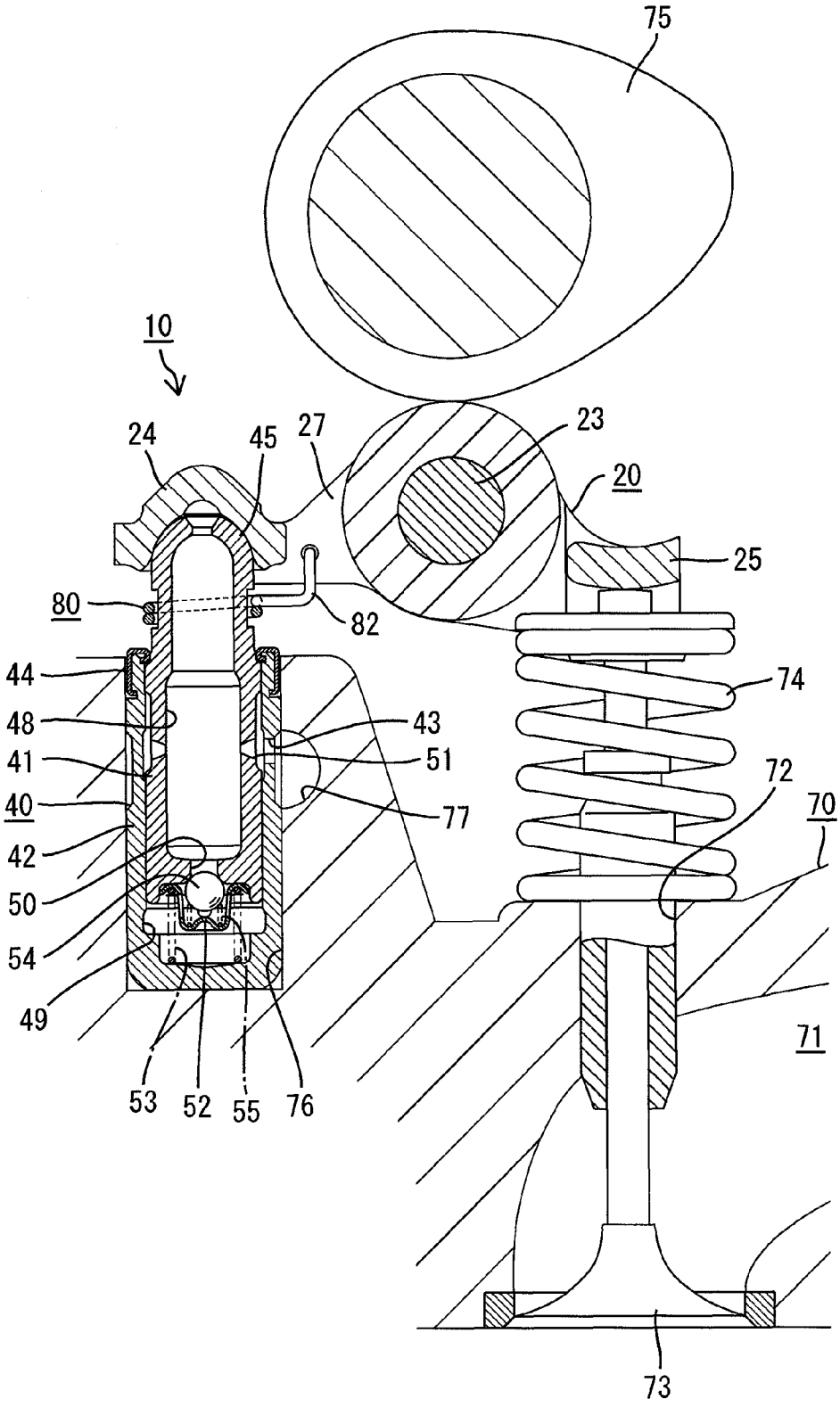
FIG. 4 is a sectional view of a valve gear including the rocker arm unit.

A whole structure of the valve gear will first be described. As shown in FIG. 4, a cylinder head 70 of the internal combustion engine includes a ventilation passage 71 (an intake or exhaust port) and a stem hole 72 which communicates with the ventilation passage 71 and is open in an outer surface of the cylinder head 70. In the stem hole 72 is provided a valve 73 (an intake or exhaust valve) which opens and closes a vent hole facing the ventilation passage 71 and is reciprocable between a valve-opened position and a valve-closed position. The valve 73 is normally biased in a valve-opening direction (upward) by a valve spring 74 and is disposed so that an upper end thereof protrudes above an upper end opening of the stem hole 72.

The rocker arm 20 and a cam 75 are provided above the cylinder head 70 to drive the valve 73. A lash adjuster 40 is mounted in a mounting hole 76 which is formed in the cylinder head 70 so as to be open in an outer surface of the cylinder head 70. A wire member 80 is provided between the rocker arm 20 and the lash adjuster 40 for connecting both of them together. An oil flow path 77 is formed inside the cylinder head 70, and an oil port is provided in the middle of the oil flow path 77 so as to face an inner surface of the mounting hole 76.

Figure 3:
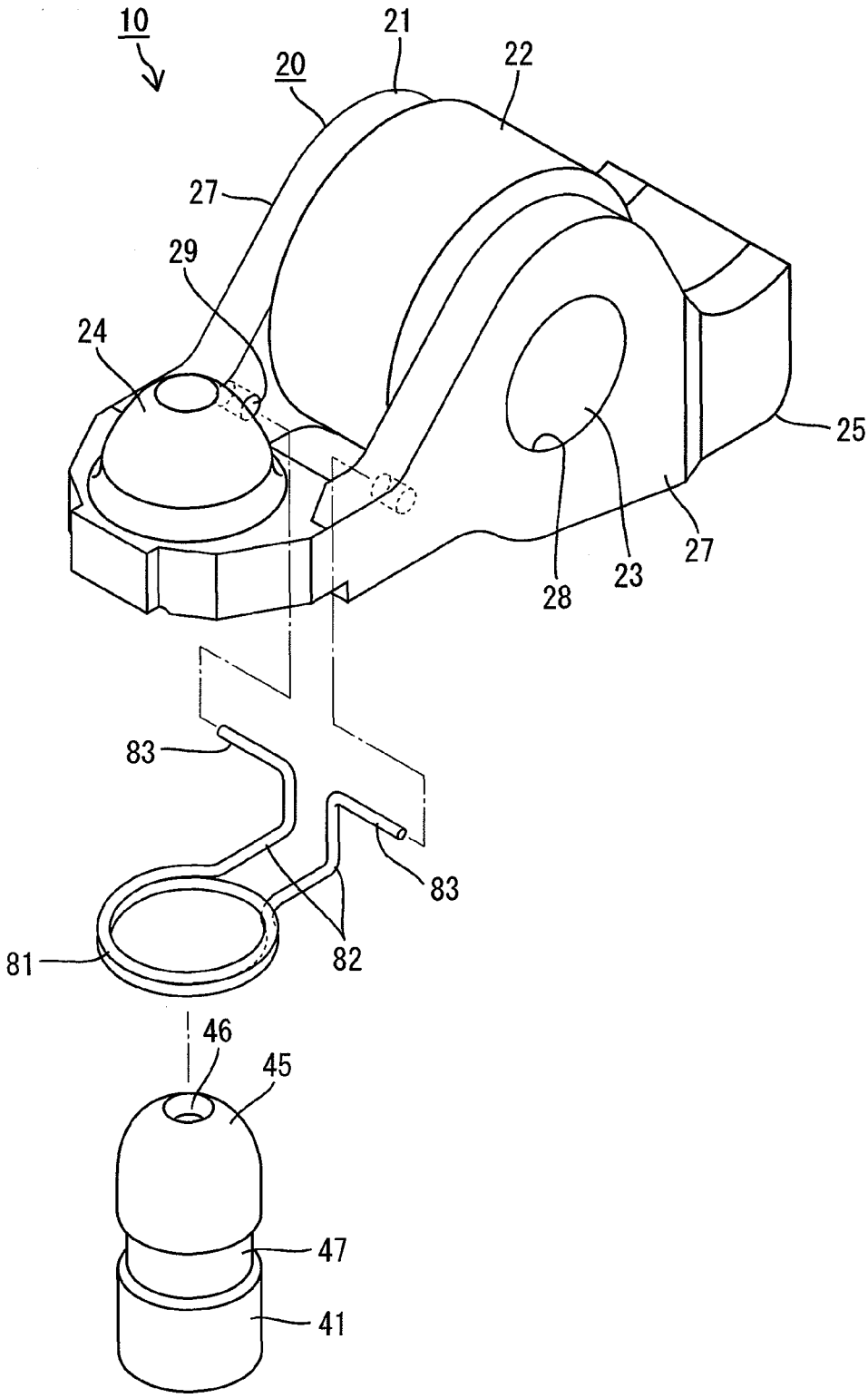
FIG. 3 is an exploded perspective view of the rocker arm unit.

The lash adjuster 40 includes a plunger 41 which is axially (vertically) elongated and supports the rocker arm 20 at an upper end thereof and a body 42 which accommodates the plunger 41 so that the plunger 41 is axially slidable and is fitted into the mounting hole 76. The body 42 is formed into the shape of an axially elongate bottomed cylinder and has a circumferential wall having a body hole 43 which is formed so as to be opposed to the oil port. An annular retainer 44 is attached around a circumferential surface of the upper end of the body 42 to retain the plunger 41. The plunger 41 is formed into a circularly cylindrical shape and has an upper end (top) provided with a support portion 45 which is rounded into a semi-spherically convex shape as shown in FIG. 3. The support portion 45 includes a central part (top end) formed with a through hole 46 through which a working fluid is supplied to the rocker arm 20. The plunger 41 has a groove-like narrowed portion 47 extending over the whole circumference.

The plunger 41 has an interior serving as a low-pressure chamber 48 as shown in FIG. 4. A high-pressure chamber 49 is defined between an underside of the plunger 41 and a bottom of the body 42. The plunger 41 includes a bottom wall which has a through hole 50 communicating with the low-pressure and high-pressure chambers 48 and 49. The plunger 41 further includes a circumferential wall having a plunger hole 51 which is formed so as to be opposed to the body hole 43. A cage 52 is provided in the high-pressure chamber 49. The cage 52 is pressed against the underside of the bottom wall of the plunger 41 by a biasing force of a first spring 53 which is in contact with an upper portion of circumferential wall of the body 42. Furthermore, a spherical check valve 54 is accommodated in the high-pressure chamber 49 for opening and closing the communication hole 50. The check valve 54 can limit a radial (the direction perpendicular to the axis) displacement of the cage 52. A second spring 55 is interposed between the cage 52 and the check valve 54 to normally bias the check valve 54 upward. The check valve 54 is constructed so as to open the valve only when a fluid pressure (hydraulic pressure) in the low-pressure chamber 48 is higher than a fluid pressure in the high-pressure chamber 49.

The rocker arm 20 includes an arm body 21, a roller 22 mounted on an intermediate portion of the arm body 21 and a shaft member 23 on which the roller 22 is rotatably mounted as shown in FIG. 3. The arm body 21 has one lengthwise end formed with a semi-spherically swollen receiving portion 24. The receiving portion 24 has an underside which is formed into a semi-spherically recessed portion and on which the support portion 45 is slidable. The arm body 21 has the other lengthwise end provided with a valve abutment portion 25 which abuts against the upper end of the valve 73.

Figure 2:
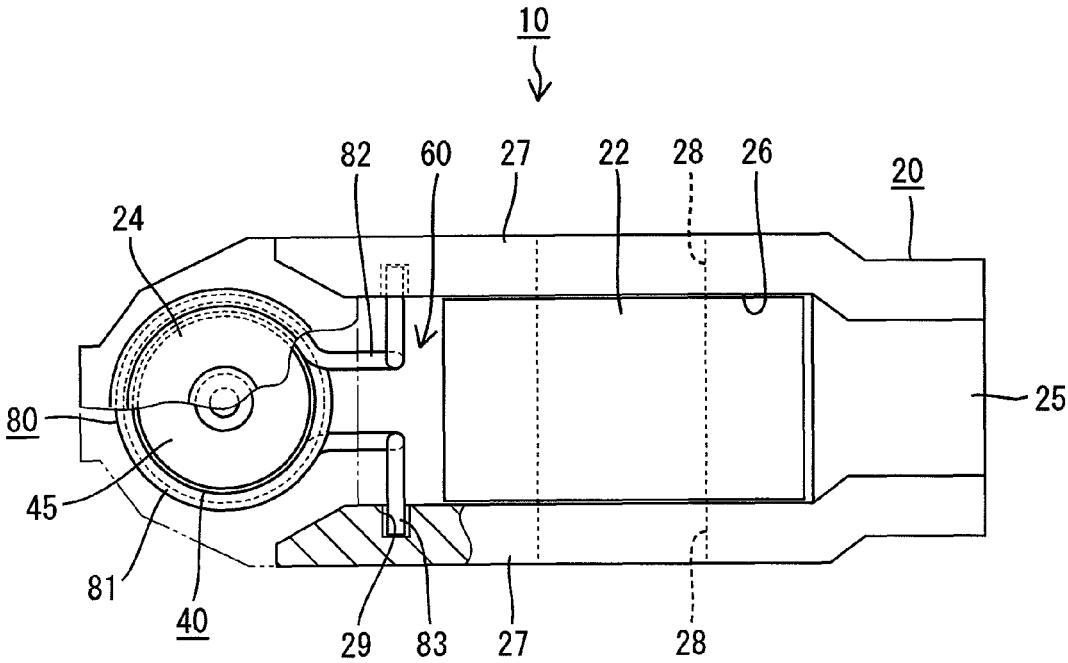
FIG. 2 is a partially broken plan view of the rocker arm unit.

The arm body 21 has a lengthwise central portion in which a roller accommodating portion 26 open upward and downward, as shown in FIG. 2. The roller accommodating portion 26 is defined by a pair of lengthwise walls 27. The walls 27 are located so as to be opposed to each other with the roller 22 being interposed therebetween. The walls 27 are connected to each other at one lengthwise ends thereof via the receiving portion 24 and also to each other at the other lengthwise ends thereof via the valve abutment portion 25. The walls 27 have shaft holes 28 which are coaxially formed and through which both ends of the shaft member 23 extend, respectively. Furthermore, the walls 27 have inner surfaces formed with bottomed holes 29 located between the shaft holes 28 and the receiving portion 24, respectively. The holes 29 receive both ends of the wire member 80 respectively. The holes 29 are disposed so as to be coaxially opposed to each other and have respective smaller circular sections than the shaft holes 28.

The roller 22 is formed into a cylindrical shape and has a hollow interior through which an intermediate portion of the shaft member 23 extends. A bearing (not shown) is interposed between the roller 22 and the shaft member 23 so as to allow rotation of the roller 22. The roller 22 has an upper end which is exposed above the upper end of the arm body 21 and which is abutted against an outer peripheral surface of an oval-shaped cam 75 from below. The cam 75 is supported on a rotating shaft which is in parallel with the shaft member 23. In the embodiment, the shaft member 23 has both ends which are accommodated in the shaft holes 28 and accordingly prevented from protruding outward beyond outer side surfaces of the walls 27, respectively.

Figure 1:
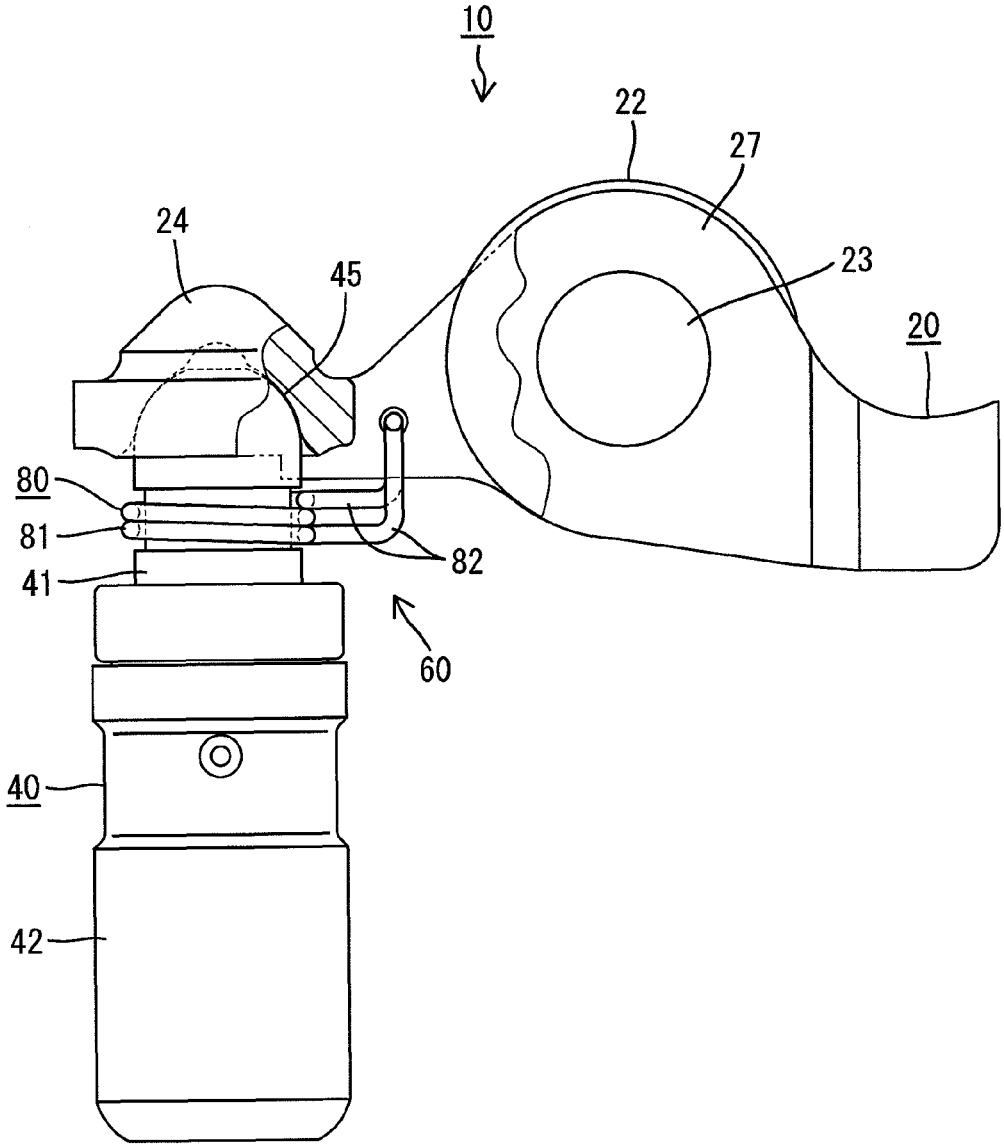
FIG. 1 is a partially broken side view of a rocker arm unit according to a first embodiment.

The wire member 80 is made by bending a single metal strip (wire) and is caused to bridge the lash adjuster 40 side and the rocker arm 20 side with each other with a predetermined spring force. More specifically, the wire member 80 includes a winding portion 81 wound on the narrowed portion 47 of the plunger 41 by at least one turn, or more preferably, by a plurality of turns and a pair of extending portions 82 which extend from both ends of the winding portion 81 toward the rocker arm 20 side respectively. The extending portions 82 are located within a generally L-shaped region 60 defined by the side surface of the plunger 41 and the underside of the rocker arm 20 as shown in FIGS. 1 and 2. The extending portions 82 firstly extend with a predetermined space therebetween substantially in the horizontal direction and are thereafter bent so as to extend substantially in the vertical direction. The extending portions 82 are further bent so as to extend outward thereby to go away from each other. The outwardly extending portions of the portions 82 serve as engagement portions 83 which are fitted into the holes 29 of the wall 27, respectively.

The assembling method and the operation of the rocker arm unit 10 will now be described. After assembly of the lash adjuster 40, the wire member 80 is fitted onto the plunger 41 from above. In the process of attachment, the winding portion 81 is slid on the support portion 45 thereby to be elastically deformed so as to be spread. Upon reaching a regular attachment position, the winding portion 81 is elastically restored thereby to clamp the narrowed portion 47. As a result, the wire member 80 is fixed to the plunger 41 in a wound state. Alternatively, the wire member 80 may be directly wound on the narrowed portion 47 so that the winding portion 81 is formed simultaneously with attachment of the wire member 80 to the plunger 41.

Subsequently, both extending portions 82 of the wire member 80 are pressed inward so that a loop diameter of the wire member 80 is elastically reduced. The receiving portion 24 of the rocker arm 20 is placed on the support portion 45 of the lash adjuster 40 while the wire member 80 is maintained in the loop-diameter reduced state. Subsequently, the extending portions 82 are released from the pressed state and elastically restored, thereafter the engagement portions 83 are inserted into the respective holes 29. As a result, both engagement portions 83 (both distal ends) of the wire member 80 are mounted on the rocker arm 20 such that the lash adjuster 40 and the rocker arm 20 are connected together by the wire member 80.

The above-described rocker arm unit is then assembled onto the valve gear. At the start of the assembly, the lash adjuster 40 is located so as to be opposed to the mounting hole 76 of the cylinder head 70 from above, and the valve abutment portion 25 of the rocker arm 20 is located so as to be opposed to the upper end of the valve 73 from above. Subsequently, when the entire rocker arm unit 10 is lowered, the lash adjuster 40 is then fitted into the mounting hole 76 and the valve abutment portion 25 of the rocker arm 20 is placed on the upper end of the valve 73, whereby both lengthwise ends of the rocker arm 20 are supported. Furthermore, the cam 75 is abutted against the roller 22 of the rocker arm 20 from above.

The assembly of the rocker arm unit 10 should not be limited to the above-described manner. For example, the lash adjuster 40 may alone be fitted into the mounting hole 76 of the cylinder head 70 and thereafter, the wire member 80 may be attached to the lash adjuster 40, and finally, the rocker arm 20 may be mounted on the distal end of the wire member 80.

Furthermore, the lash adjuster 40 with the wire member 80 may be fitted into the mounting hole 76 of the cylinder head 70 and thereafter, the rocker arm 20 may be mounted on the distal end of the wire member 80.

During drive of the valve gear, the rocker arm 20 is vertically swung (oscillates) with rotation of the cam 75 such that the semispherical convex portion of the support portion 45 and the semispherical concave portion of the receiving portion 24 are brought into sliding contact with each other. In this case, the extending portions 82 are elastically deformed such that the rocker arm 20 is allowed to swing. Furthermore, when the winding portion 81 has such an oval shape that a lengthwise clearance with respect to the rocker arm 20 is retained between the winding portion 81 and the narrowed portion 47, the rocker arm 20 is allowed to swing within the range of the clearance. Thus, the winding portion 81 may have such an oval shape as described above. Still furthermore, a tightening force the winding portion 81 applies to the narrowed portion 47 may be reduced such that the winding portion 81 is vertically movable in the narrowed portion 47.

According to the above-described embodiment, the wire member 80 is used to connect the lash adjuster 40 and the rocker arm 20 together. Differing from the conventional clip, the wire member 80 does not necessitate the work of punching a metal plate into a predetermined shape and of shaping the metal plate into a complicated shape. Consequently, the manufacturing cost of the rocker arm unit 10 can be reduced. Moreover, making use of the spring force of the wire member 80 can improve an assembly efficiency and in addition, the rocker arm 20 can be allowed to swing.

Furthermore, since the wire member 80 bridges the plunger 41 side and the rocker arm 20 side with each other, the wire member 80 is displaced following the movement of the plunger 41, whereupon the wire member 80 can be displaced without any problem of the variations in the support position of the support portion 45. Furthermore, since the wire member 80 has the winding portion 81 which is wound on the outer circumferential surface of the plunger 41, the wire member 80 can be mounted on the plunger 41 without any special machining process for the plunger 41.

Furthermore, the distal ends of the wire member 80 serve as the engagement portions 83 which are inserted into the holes 29 formed in the wall 27 of the rocker arm 20, respectively. Accordingly, a manner of mounting the wire member 80 on the rocker arm 20 can be prevented from being complicated. Moreover, since the engagement portions 83 are inserted, from inside the rocker arm 20, into the respective holes 29 which are open in the inner surface of the wall 27, the engagement portions 83 can avoid disengagement from the rocker arm 20 due to interference with external foreign matter.

Figure 5:
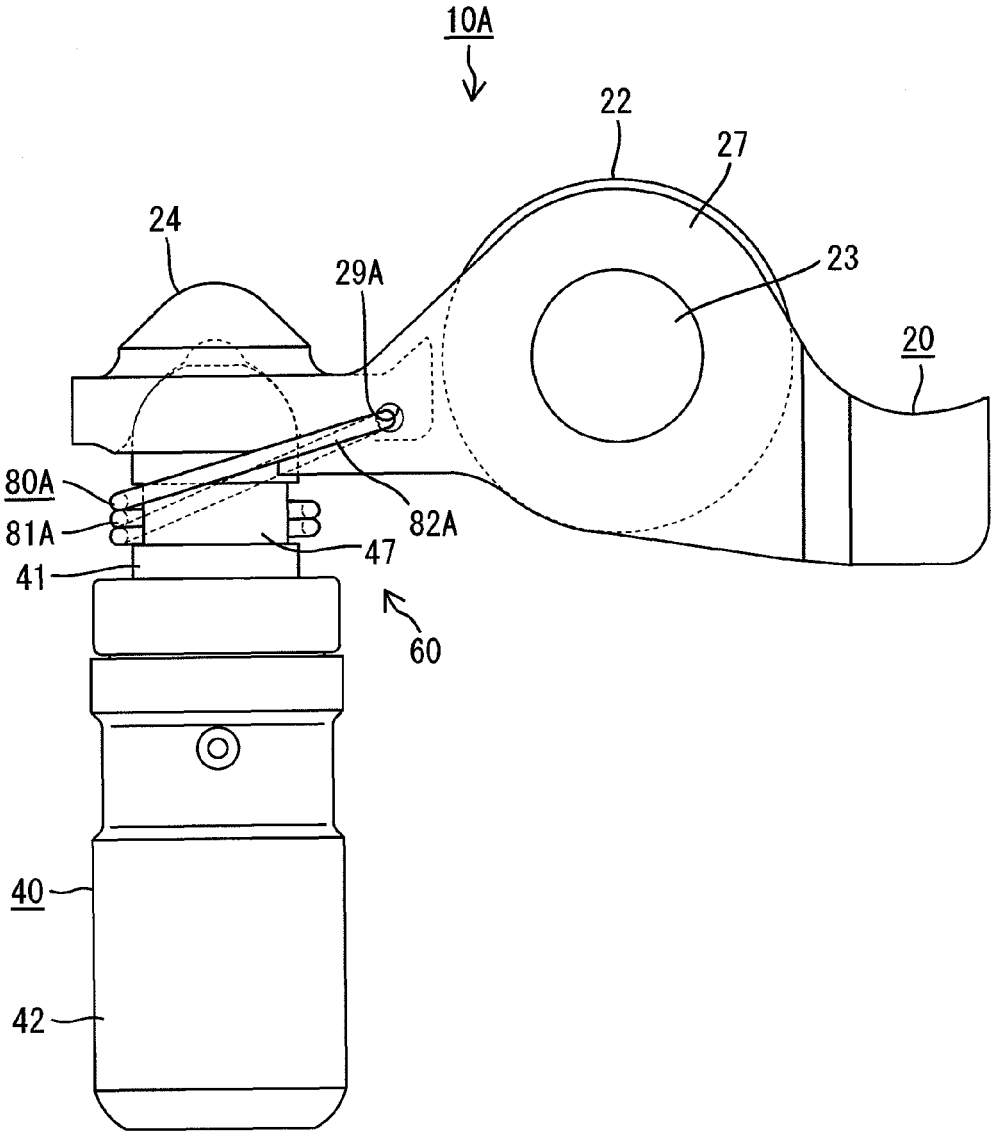
FIG. 5 is a side view of the rocker arm unit according to a second embodiment.
Figure 6:
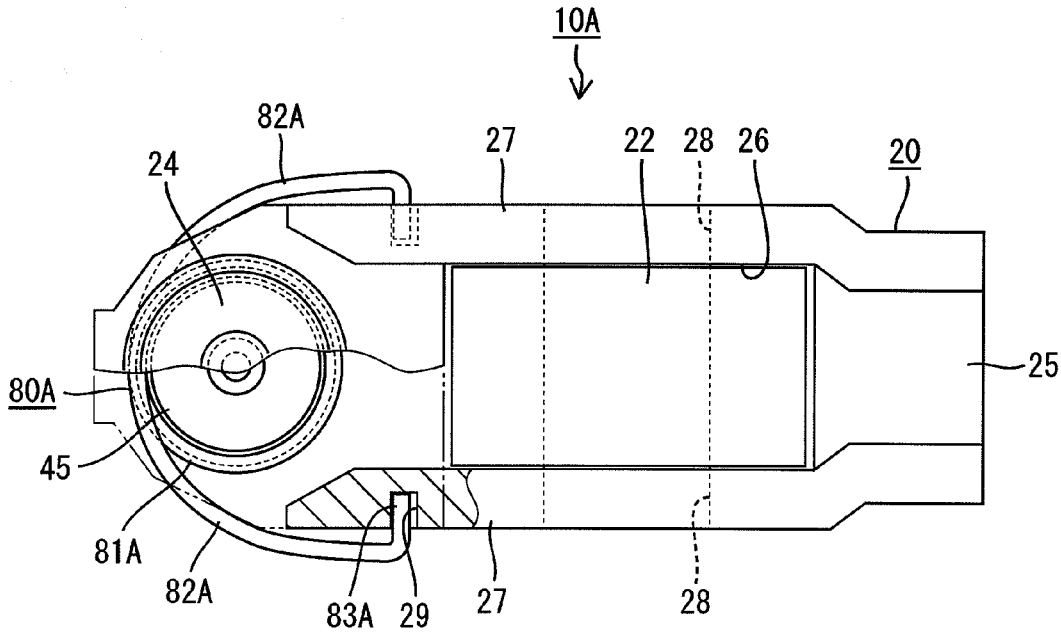
FIG. 6 is a partially broken plan view of the rocker arm unit.

FIGS. 5 and 6 illustrate a second embodiment. A rocker arm unit 10A according to the second embodiment differs from the above-described rocker arm unit 10 in the manner of mounting the wire member 80 on the rocker arm 20. The second embodiment is similar to the first embodiment in the other respects. Accordingly, identical or similar parts in the second embodiment are labeled by the same reference symbols as those in the first embodiment and will not be described in the second embodiment.

The wire member 80A includes a winding portion 81A which is wound on the narrowed portion 47 by a plurality of turns and extending portions 82A which extend from both ends of the winding portion 81A to the side of the outer surface of the rocker arm 20. Both ends of the winding portion 81A are disposed so as to cross the side surface of the narrowed portion 47 located opposite the above-described L-shaped region 60. The extending portions 82A are introduced from both ends of the winding portion 81A to the outer surface sides of the rocker arm 20 so as to extend along outer circumferential portions of the plunger 41, respectively. The extending portions 82A have distal ends which are inwardly bent into the engagement portions 83A respectively.

The rocker arm 20 includes two side walls 27 having outer surfaces formed with two bottomed holes 29A which are located at the receiving portion 24 side and receive the engagement portions 83A, respectively. Both holes 29A are disposed coaxially and have the same shape and the same size. The holes 29A have respective smaller circular cross-sectional shapes than the shaft holes 28.

According to the second embodiment, the engagement portions 83A are inserted into the holes 29A open in the outer surfaces of the walls 27 from outside the walls 27 respectively. The inserting work can be simplified. Furthermore, hole making can be rendered easier in the forming of the holes 29A.

Figure 7:
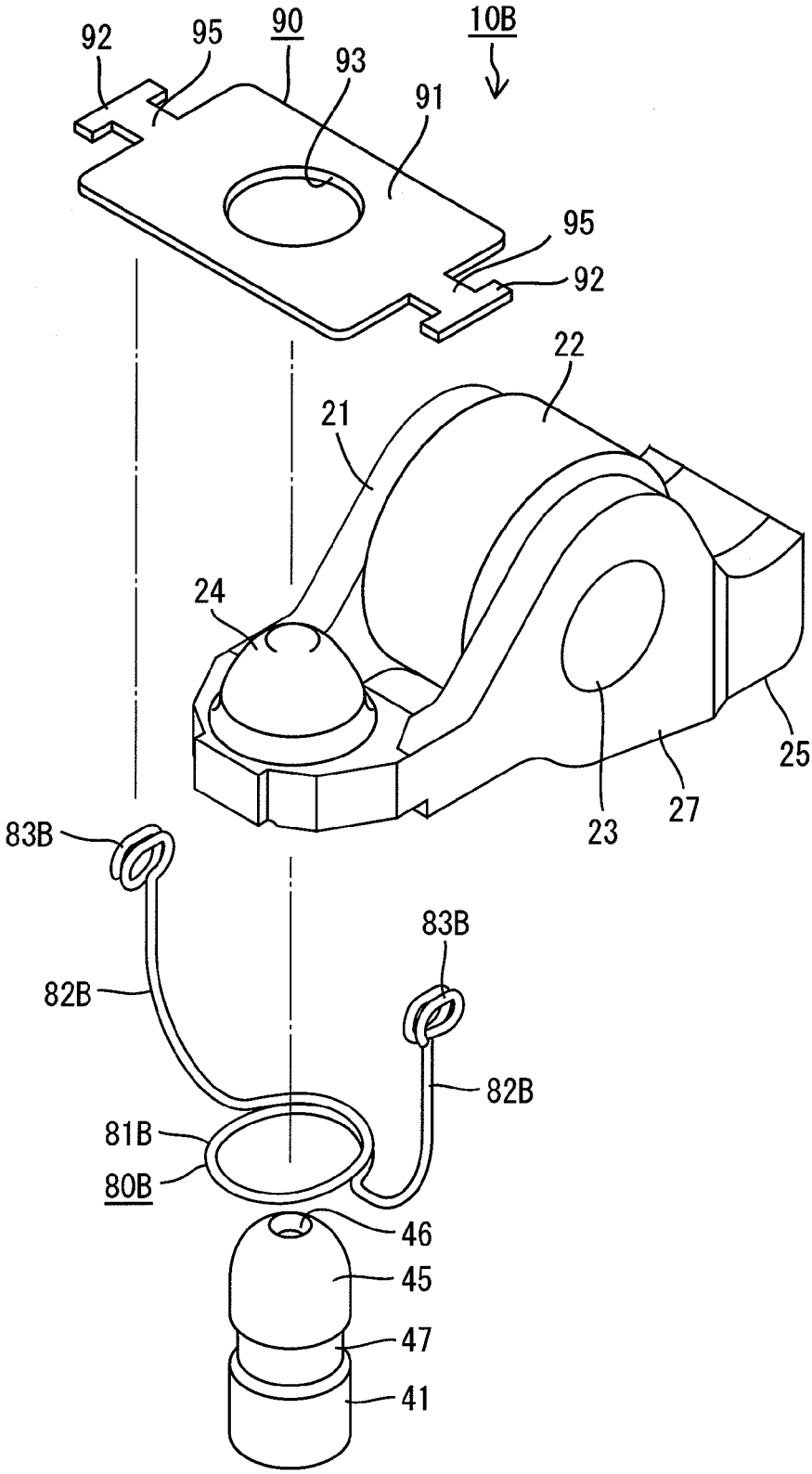
FIG. 7 is an exploded perspective view of the rocker arm unit according to a third embodiment.
Figure 8:
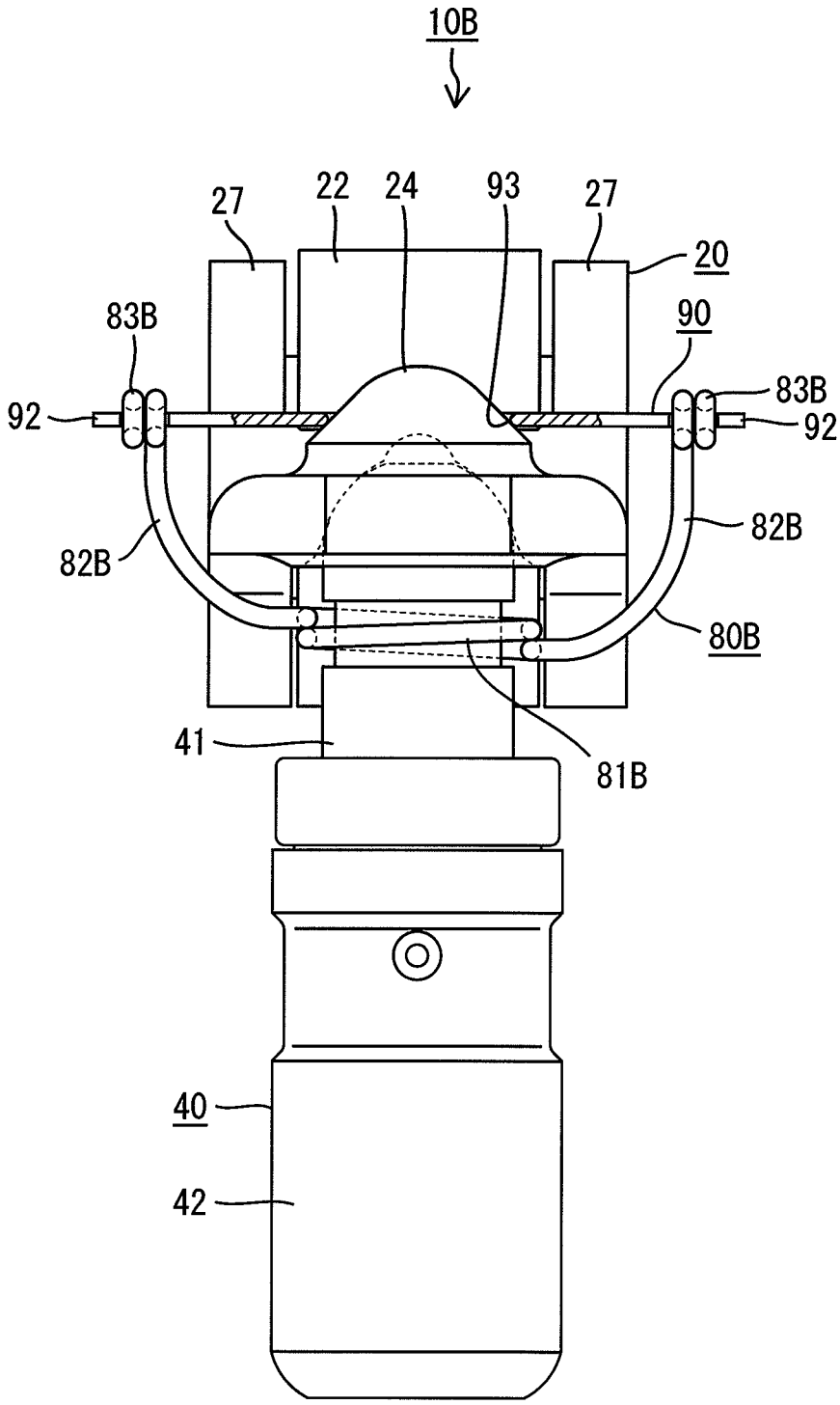
FIG. 8 is a partially broken front view of the rocker arm unit.

FIGS. 7 and 8 illustrate a third embodiment. A rocker arm unit 10B according to the third embodiment differs from the above-described rocker arm units 10 and 10A in that the wire member 80B is indirectly passed via a plate 90 to the rocker arm unit 10. The wire member 80B includes a winding portion 81B wound on the narrowed portion 47 of the plunger 41 by one turn and a pair of extending portions 82B which rise from both radial ends of the winding portion 81B toward outside the outer surfaces of the rocker arm 20 respectively. The winding portion 81B is formed into an oval shape and is long in the lengthwise direction of the rocker arm 20. A lengthwise clearance with respect to the rocker arm 20 is defined between the winding portion 81B and the narrowed portion 47. The rocker arm 20 is allowed to swing within the range of the clearance. Both extending portions 82B have respective distal ends which serve as the engagement portions 83B to be hooked on the plate 90.

The plate 90 is made of a metal and includes a generally rectangular body 91 and a pair of lock receiving portions 92 protruding outward from both ends of the body 91 respectively. The plate 90 is disposed so that the receiving portion 24 of the rocker arm 20 is received between the body 91 and the support portion 45 of the plunger 41. The body 91 is formed with a circular positioning hole 93 into which the receiving portion 24 is fitted. The lock receiving portions 92 are each formed into a T-shape and have respective narrowed portions 95 on which the engagement portions 83 are wound, whereby the wire member 80B is mounted on the plate 90.

According to the third embodiment, the rocker arm 20 can maintain the integrity with the lash adjuster 40 while being held between the plate 90 and the support portion 45 of the plunger 41. In this case, the versatility of the rocker arm unit 10B can be improved since no special machining process is applied to the lash adjuster 40 or the rocker arm 20. Furthermore, when the receiving portion 24 is fitted into the positioning hole 93, the rocker arm 20 can be positioned relative to the plate 90 and accordingly, the rocker arm 20 can be positioned relative to the plunger 41.

Figure 9:
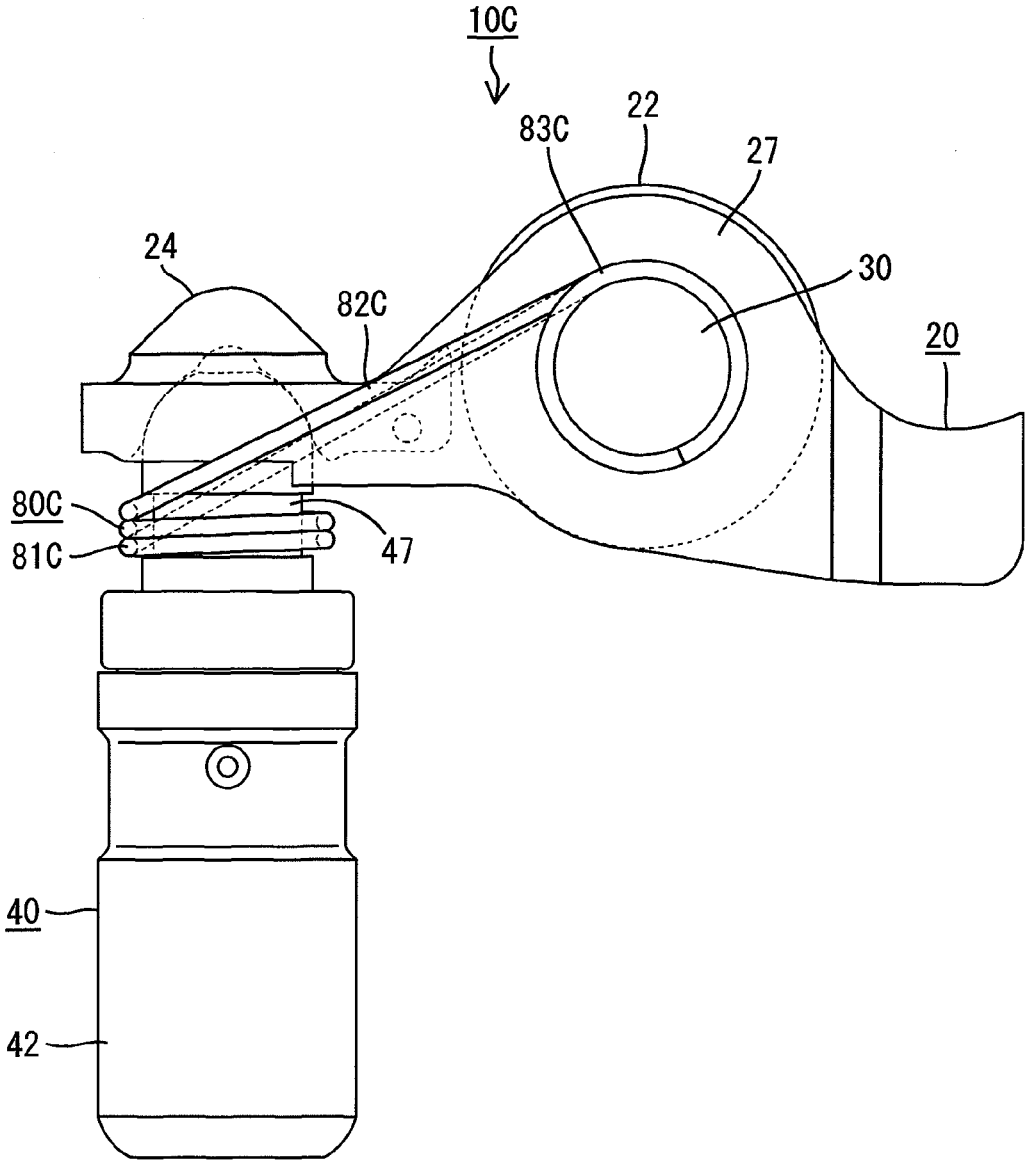
FIG. 9 is a side view of the rocker arm unit according to a fourth embodiment.
Figure 10:
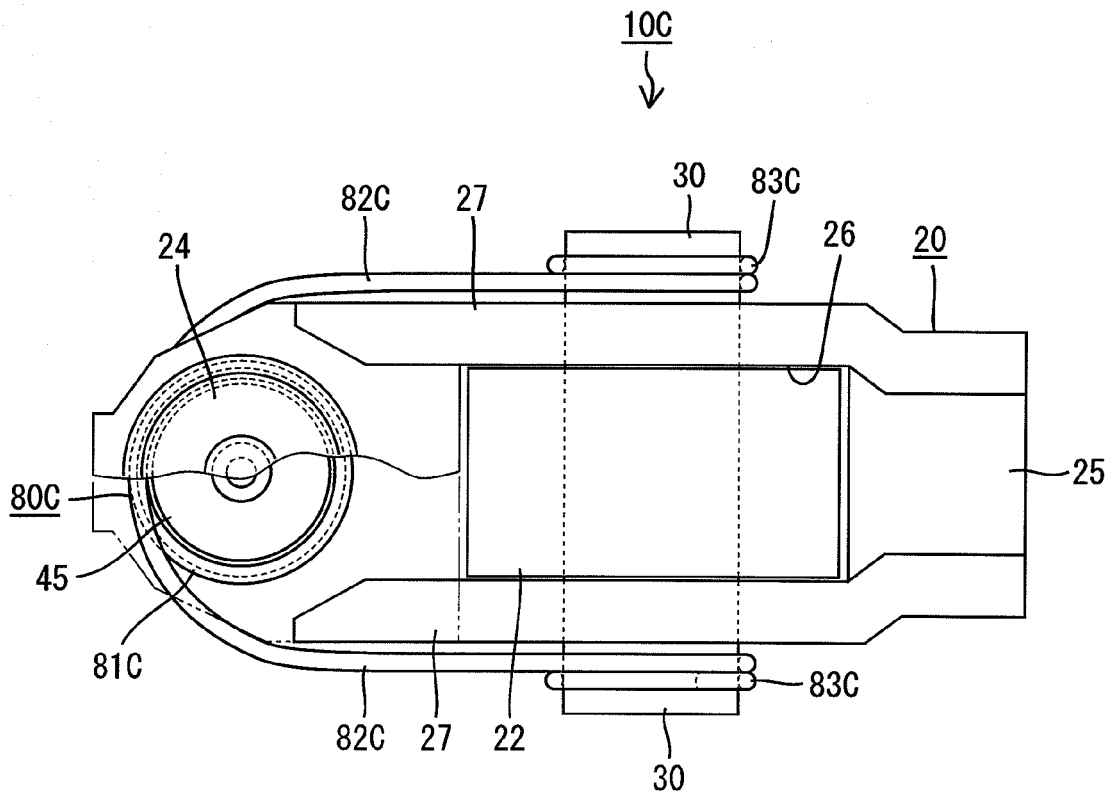
FIG. 10 is a partially broken plan view of the rocker arm unit.

FIGS. 9 and 10 illustrate a fourth embodiment. A rocker arm unit 10C according to the fourth embodiment differs from the above-described rocker arm units 10, 10A and 10B in the manner of mounting the wire member 80C on the rocker arm 20. The rocker arm 20 includes a shaft member 23 extending through the shaft holes 28 of the walls 27. The shaft member 23 has both ends having two circular cylindrical protrusions 30 which protrude outward farther than the outer surfaces of the walls 27, respectively.

The wire member 80C includes the winding portion 81C wound on the narrowed portion 47 by a plurality of turns and the extending portions 82C extending from both ends of the winding portion 81C toward the outer surface sides of the rocker arm 20 respectively. Each extending portion 82C is formed into such a shape as to extend obliquely linearly toward the corresponding protrusion 30 and has a distal end serving as the engagement portion 83C to be wound on the outer circumferential surface of the protrusion 30. Accordingly, the wire member 80C is mounted on the rocker arm 20 when the engagement portions 83C are wound on the outer circumferential surface of the protrusion 30.

According to the fourth embodiment, since the engagement portions 83C are mounted on the protrusion 30, the wall surfaces of the rocker arm 20 need not be bored for the forming of the holes 29, 29A.

Figure 11:
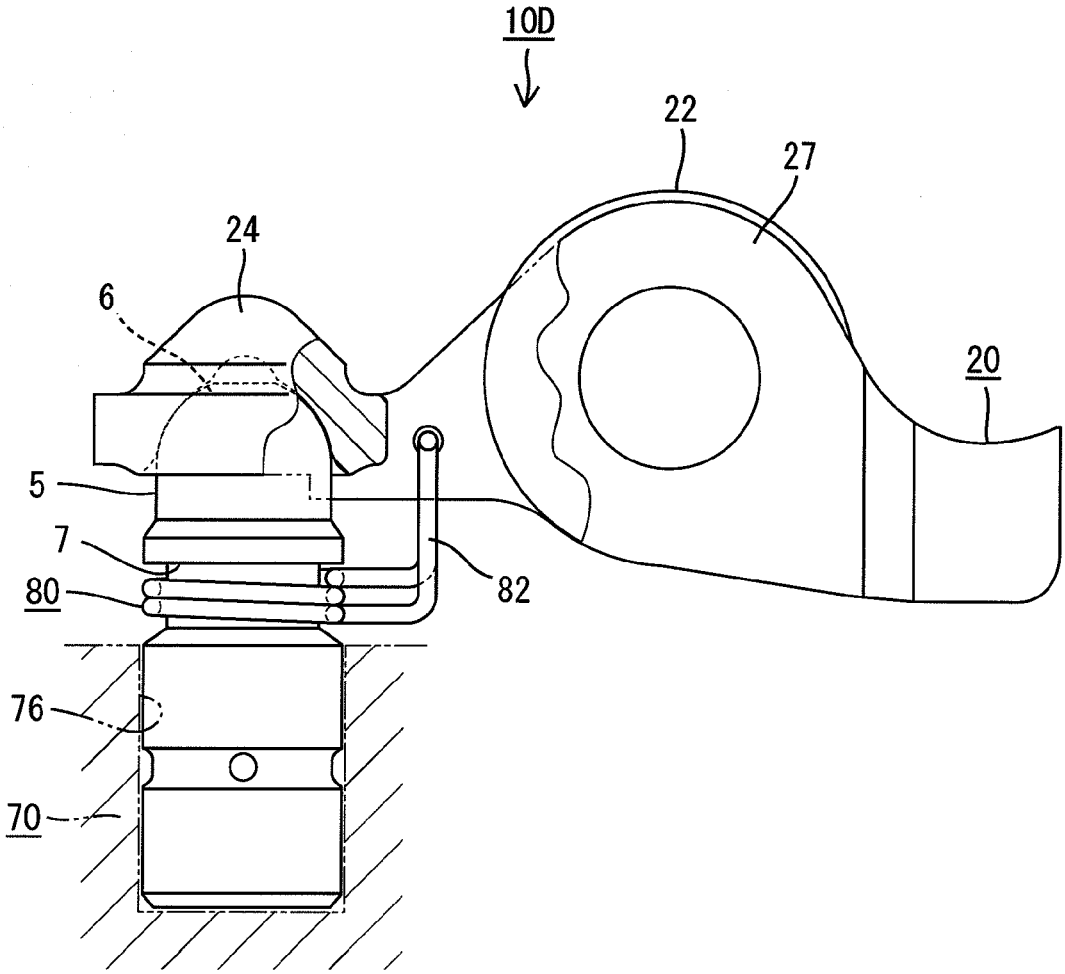
FIG. 11 is a side view of the rocker arm unit according to a fifth embodiment.

FIG. 11 illustrates a fifth embodiment. A rocker arm unit 10D according to the fifth embodiment differs from the rocker arm unit 10 according to the first embodiment in that a pivot 5 is used as the support member, instead of the lash adjuster 40. The pivot 5 is a single rigid member which can support the rocker arm 20 at a predetermined vertical position, and is inserted into a mounting hole 76 of the cylinder head 70. Thus the pivot 5 is disallowed to move vertically, differing from the plunger 41. The pivot 5 has a top provided with a support portion 6 which supports the rocker arm 20 so that the rocker arm 20 is swingable. Furthermore, the pivot 5 has a peripheral surface formed with the narrowed portion 7 extending along a whole circumference of the pivot 5. The wire member 80 is wound on the narrowed portion 7. The configuration of the wire member 80, a manner of mounting the wire member 80 on the rocker arm 20 and the like in the fifth embodiment are similar to those in the first embodiment.

The foregoing embodiments should not be restrictive but may be modified as follows. The wire member may be wound on the body in each of the first to fourth embodiments. The winding portion may be wound on the plunger having no narrowed portion or the outer circumferential surface of the pivot in each of the first to fifth embodiments. In each of the first to fifth embodiments, the winding portion may be wound on the plunger, the body or the outer circumferential surface of the pivot by less than one turn so as to be generally formed into a C-shape. Additionally, the pivot as exemplified in the fifth embodiment may be used in each of the first to fourth embodiments, instead of the lash adjuster.

The foregoing description and drawings are merely illustrative of the principles and are not to be construed in a limiting sense. Various changes and modifications will become apparent to those of ordinary skill in the art. All such changes and modifications are seen to fall within the scope as defined by the appended claims.

What is claimed is:

1. A rocker arm unit constituting a valve gear of an internal combustion engine having a cylinder head, the unit comprising:

a support member assembled into the cylinder head;

a rocker arm including a roller configured for rotation by a cam and a pair of walls opposed to each other with the roller being interposed therebetween, the walls having shaft holes into which both ends of a shaft member rotatably supporting the roller extend respectively, the walls having respective lengthwise ends connected via a receiving portion to each other, the receiving portion being supported on a top of the support member so that the rocker arm is swung with the receiving portion serving as an fulcrum; and a wire member bridging the support member side and the rocker arm side with each other thereby to connect the support member and the rocker arm together, the wire member having an extending portion which extends from the support member side to the rocker arm side and has a distal end, the rocker arm side including a part located away from the receiving portion, the distal end of the extending portion serving as an engagement portion which engages said part of the rocker arm side.

2. The rocker arm unit according to claim 1, wherein the wire member comprises a single wire.

3. The rocker arm unit according to claim 1, wherein the support member has an outer peripheral surface and the wire member is wound on the outer peripheral surface of the support member.

4. The rocker arm unit according to claim 3, wherein the wire member is wound on the outer peripheral surface of the support member by at least one turn.

5. The rocker arm unit according to claim 3, wherein the wire member includes a winding portion wound on the outer peripheral surface of the support member and said extending portion comprises a pair of extending portion extensions which extend, respectively, from two ends of the winding portion toward the rocker arm side.

6. The rocker arm unit according to claim 1, wherein the wire member has a distal end and the rocker arm has a wall surface formed with a hole, and the distal end of the wire member is inserted into the hole of the rocker arm side.

7. The rocker arm unit according to claim 6, wherein the wall surface formed with the hole is an inner wall surface of the rocker arm, and the distal end of the wire member is configured for insertion into the hole from inside the rocker arm.

8. The rocker arm unit according to claim 7, wherein the inner wall surface in which the hole is open is defined by one of said pair of walls.

9. The rocker arm unit according to claim 6, wherein the rocker arm has an outer wall surface in which the hole is open, and the distal end of the wire member is inserted into the hole from outside the rocker arm.

10. The rocker arm unit according to claim 9, wherein the outer wall surface in which the hole is open is defined by one of said pair of walls.

11. The rocker arm unit according to claim 1, wherein the distal end of the wire member is fixed to a plate so that the rocker arm is held between the support member and the plate.

12. The rocker arm unit according to claim 1, wherein:

the shaft member has two ends serving as protrusions which protrude outward farther than an outer wall surface of the rocker arm, respectively; and the distal end of the wire member is mounted on one of the protrusions.

13. The rocker arm unit according to claim 1, wherein the support member comprises a lash adjuster including a cylindrical body and a plunger accommodated in the body so that the plunger is slidable in the body, and the wire member bridges the plunger side and the rocker arm side with each other.

14. The rocker arm unit according to claim 13, wherein the plunger has an outer peripheral surface provided with a narrowed portion, and the wire member is wound on the narrowed portion.

15. The rocker arm unit according to claim 1, wherein the support member comprises a pivot supporting the rocker arm at a vertical constant position.

16. The rocker arm unit according to claim 1, wherein the distal end of said extending portion pivotably engages, in a projection-recess arrangement, with said part of the rocker arm side.

17. The rocker arm unit according to claim 16, wherein a pivot axis of said projection-recess arrangement is parallel with an axis of rotation of said roller.

* * * * *